US005629679A

United States Patent [19]

Cranford et al.

[11] Patent Number: 5,629,679

[45] Date of Patent: May 13, 1997

[54] PERSONAL SECURITY DEVICE

[76] Inventors: Richard Cranford, 401 Greensward La., A104, Del Ray Beach, Fla. 33445; D. Robert Jordan, 1094 Fisher La., Winnetka, Ill. 60093

[21] Appl. No.: 356,506

[22] Filed: Dec. 15, 1994

[51] Int. Cl.[6] ..... G08B 13/00

[52] U.S. Cl. ..... 340/574; 200/519; 340/321; 340/693

[58] Field of Search ..... 340/574, 321, 340/693, 691; 222/78–79, 3; 116/DIG. 44; 42/1.08; 273/84 R, 84 ES; 362/112; 200/5 R, 11 R, 16 R, 61.85, 332.2, 519

[56] References Cited

U.S. PATENT DOCUMENTS

| | | | |
|---|---|---|---|
| 2,536,484 | 1/1951 | Avery | 362/112 |
| 3,443,333 | 5/1969 | Manatos | 42/1.08 |
| 3,669,533 | 6/1972 | DeAngelis | 200/519 X |
| 3,865,370 | 2/1975 | Rogers | 273/84 R |
| 4,058,921 | 11/1977 | Mason | 222/79 X |
| 4,092,695 | 5/1978 | Henderson et al. | 361/232 |
| 4,223,804 | 9/1980 | Morris et al. | 222/3 |
| 4,843,336 | 6/1989 | Kuo | 340/321 X |
| 5,086,377 | 2/1992 | Roberts | 362/102 |
| 5,193,048 | 3/1993 | Kaufman et al. | 273/84 ES X |
| 5,289,164 | 2/1994 | Novak | 340/574 |
| 5,397,029 | 3/1995 | West | 222/79 |
| 5,446,985 | 9/1995 | Chen | 42/1.08 |

FOREIGN PATENT DOCUMENTS

| | | | |
|---|---|---|---|
| 2406859 | 6/1979 | France | 340/574 |
| 2671294 | 7/1992 | France | 222/79 |
| 3215729 | 10/1984 | Germany | 273/84 R |
| 278979 | 2/1952 | Switzerland | 222/79 |
| 1187979 | 4/1970 | United Kingdom | 273/84 R |

*Primary Examiner*—Thomas Mullen
*Attorney, Agent, or Firm*—Dennis H. Lambert

[57] ABSTRACT

A portable personal security device of compact size capable of being carried in a pocket or purse or the like, has a pistol-like configuration with a handgrip portion and a barrel portion. The device includes a noxious chemical which may be discharged to fend off an attack by an assailant, and an audible alarm which may be sounded to attract attention and/or to discourage an attacker. Further, a light is provided on the device so that it can be used as a flashlight. A plurality of finger-receiving openings are formed in the handgrip portion to effect a secure grip on the device and make it difficult to dislodge from the hand of the user. These openings also assist in quickly and properly orienting the device. An actuator for energizing the light, the chemical discharge and the audible alarm includes structure which enables sequential activation of these devices. A timer in the audible alarm circuit maintains the audible alarm activated for a predetermined time after the actuator is released, and a shock sensor is operative to activate the audible alarm in the event of an impact against the device.

5 Claims, 5 Drawing Sheets

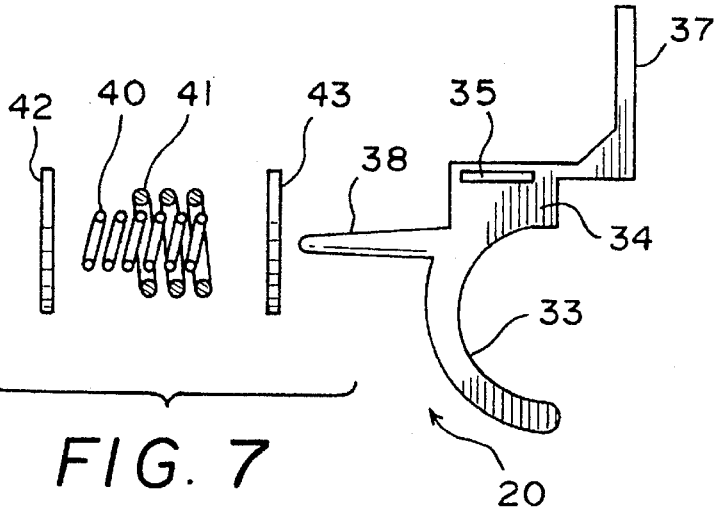
FIG. 7
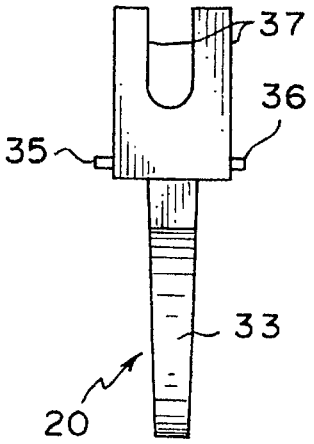
FIG. 8
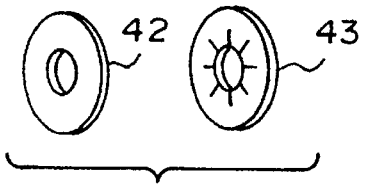
FIG. 7A
FIG. 9
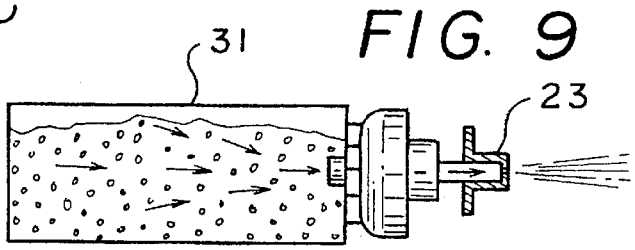
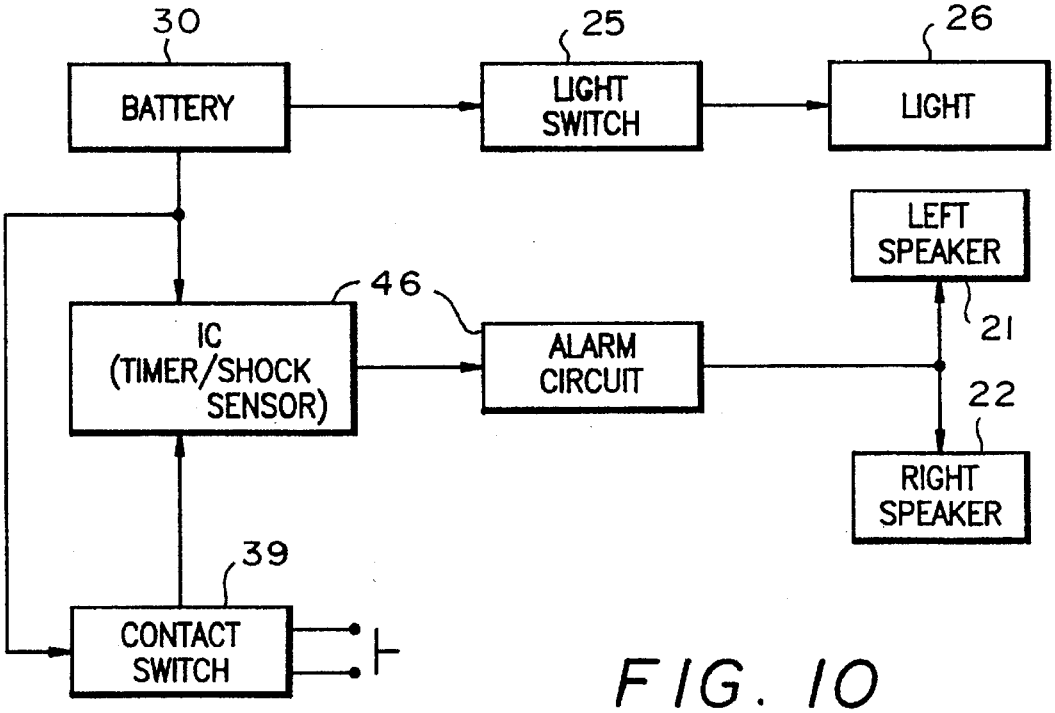
FIG. 10

PERSONAL SECURITY DEVICE

FIELD OF THE INVENTION

This invention relates generally to personal security, and particularly to a portable personal protection device that may be carried for use to sound an alarm and/or to dispense a noxious chemical in the event of an attack or threatened attack by an assailant.

DETAILED OF THE PRIOR ART

Personal defense devices have been known for many years, and range from simple noise makers to stun guns and devices for spraying mace or other noxious chemicals to disable or discourage an attacker. Audible alarms alone can be effective to discourage or scare off an attacker, but will not stop an attack from a determined assailant, especially someone high on drugs or suffering from other emotional disturbance. A stun gun or dispenser of a noxious chemical may be effective in stopping even a determined assailant, but conventional devices of this type can also present a danger to the user or to children. For example, a stun gun can be dangerous to use in wet conditions. In addition, all such devices known to applicant can be knocked relatively easily from the hand of the person using them, thereby rendering the device useless.

Moreover, most conventional personal defense devices provide only one form of protection, i.e., they either make noise, dispense a noxious chemical, or produce a disabling charge of electricity. These devices may therefore either attract attention, or temporarily disable the attacker, but generally will not perform both functions. Moreover, at night time it may be necessary for a person to carry a light, thereby making it difficult to quickly access and operate a personal defense device. Since most attacks on individuals are carried out with little warning, it may not be possible for the victim to use a personal defense device under such conditions.

Some attempts have been made in the prior art to develop personal defense devices which possess more than one form of protection, i.e., they will emit an audible alarm and also discharge a noxious chemical or provide a disabling charge of electricity. Other prior art devices also provide a light for use as a flashlight during hours of darkness. However, these devices do not provide any means to make them difficult to dislodge from the hand of the user, nor do they have any means to minimize the chance that a child will accidentally discharge a noxious chemical or a disabling charge of electricity from the device if they should gain access to it. Further, conventional devices may be relatively large and cumbersome to carry and use, or not have any means to facilitate aiming.

There is thus need for a personal defense device that is simple and effective to use, which does not present a danger to children who might gain access to the device, and further, which is not easily dislodged from the hand of the user and which may be quickly and easily aimed.

SUMMARY OF THE INVENTION

Accordingly, it an object of the present invention to provide a portable personal security device that is compact and reliable in design, and which has features rendering it safe around small children.

Another object of the invention is to provide a personal defense device that has features making it difficult to dislodge from the hand of the user, and which is also easy to aim.

A further object of the invention is to provide a personal defense device which has multiple functions, enabling it to be used to emit an audible alarm as well as a device to discharge a noxious chemical.

Yet another object of the invention is to provide a personal defense device having multiple functions, whereby it may be used as a flashlight as well as a personal defense device capable of emitting an audible alarm and/or noxious chemical to ward off an attack, thereby eliminating any delay in using the device when the need may arise at night.

In achieving the foregoing as well as other objects and advantages, the device of the invention is shaped with a pistol-like grip having openings for receiving the fingers of the user. An actuating trigger is positioned in one of the openings for selectively actuating an audible alarm and/or discharging a noxious chemical such as mace or pepper gas or the like. The openings provide a secure grip which makes it difficult to dislodge the device from the hand of the user. Further, the structure and arrangement of the grip automatically orients the device for proper aiming of it, and enables the user to grasp the device in his or her pocket, pocketbook, or the like, and quickly ascertain by tactile sensation the proper orientation of the device for use.

A light and actuating switch are provided on the device so that it may be used as a flashlight during darkness. The light is positioned to shine in the same direction as any chemical that may be discharged, and may therefore function as an aiming device. Moreover, when the device is being used as a flashlight it is instantly available for use as a personal security device in the event of a surprise attack.

The actuating trigger for energizing the audible alarm and for discharging a noxious chemical is constructed such that when it is operated the audible alarm is first energized, and only after overcoming a predetermined resistance is the noxious chemical discharged. This feature ensures that if a child gains access to the device and attempts to use it, the audible alarm will first sound, startling the child and in all likelihood causing him or her to drop the device before discharge of the chemical is accomplished. In addition, the resistance which must be overcome before the chemical can be discharged will make it unlikely that a child will cause discharge of the chemical.

BRIEF DESCRIPTION OF THE DRAWINGS

The foregoing, as well as other objects and advantages of the invention, will be described in detail hereinafter, wherein like reference characters designate like parts throughout the several views, and wherein:

FIG. 7 is an enlarged, exploded view of the actuating trigger and return springs, with retaining washers;

FIG. 7A is an exploded perspective view of the two washers used in the spring assembly of FIG. 7;

FIG. 8 is a front view in elevation of the trigger of FIG. 7;

FIG. 9 is a somewhat schematic side view of the chemical container and dispensing valve, depicting how the chemical is discharged straight through the valve and nozzle;

FIG. 10 is a schematic block diagram of the major operational components of a first embodiment of the invention, showing the separate switch for the light.

DETAILED DESCRIPTION OF THE PREFERRED EMBODIMENTS

Figure 1:
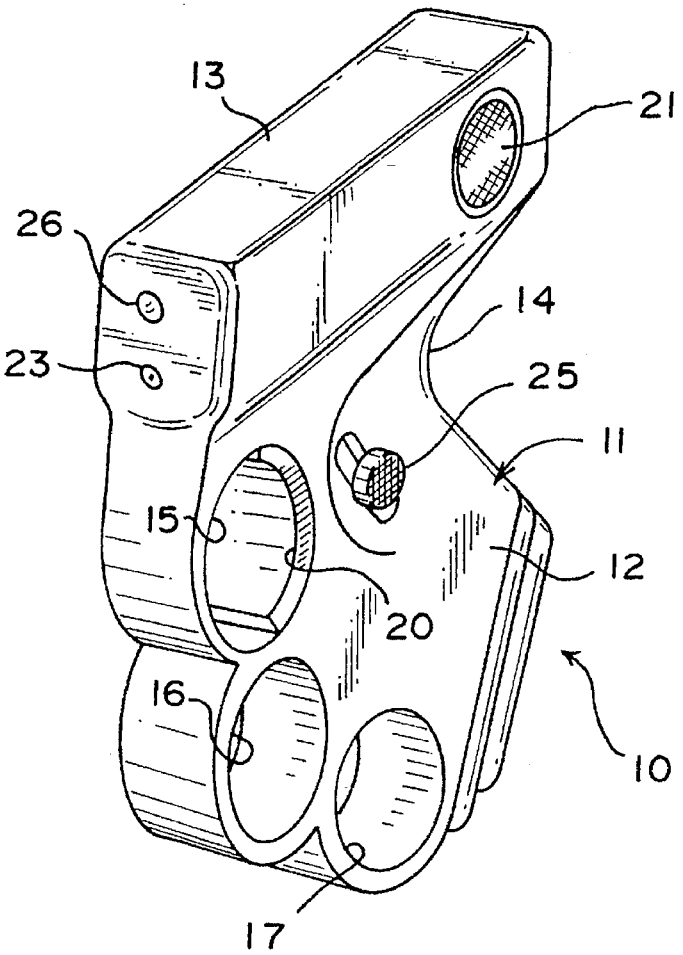
FIG. 1 is a front perspective view of the personal security device of the invention.
Figure 2:
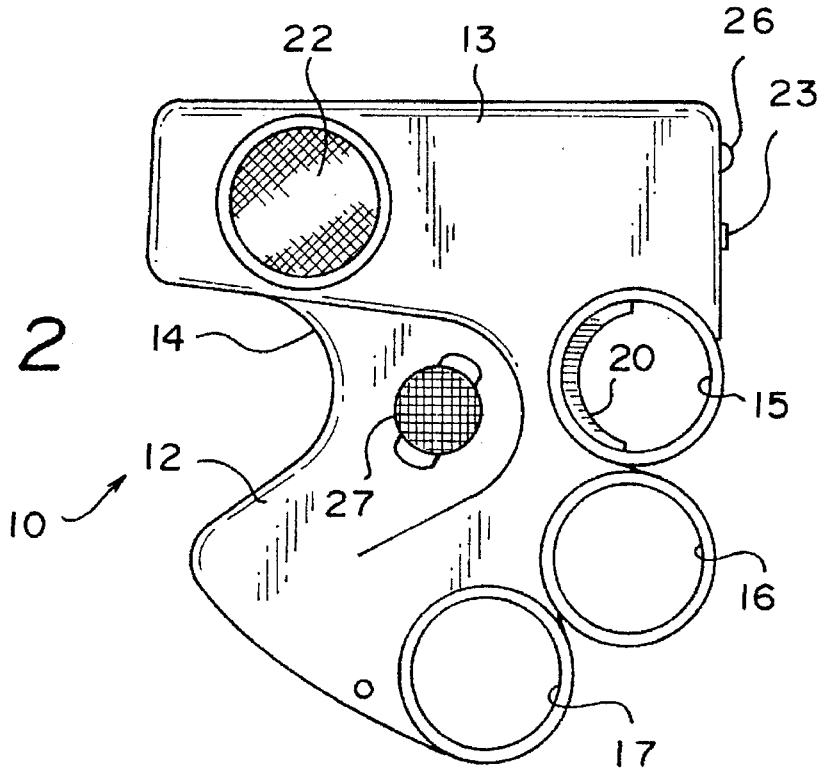
FIG. 2 is a right side view in elevation of the device of FIG. 1, showing an optional safety that may be incorporated to prevent operation of the trigger to discharge the chemical.
Figure 3:
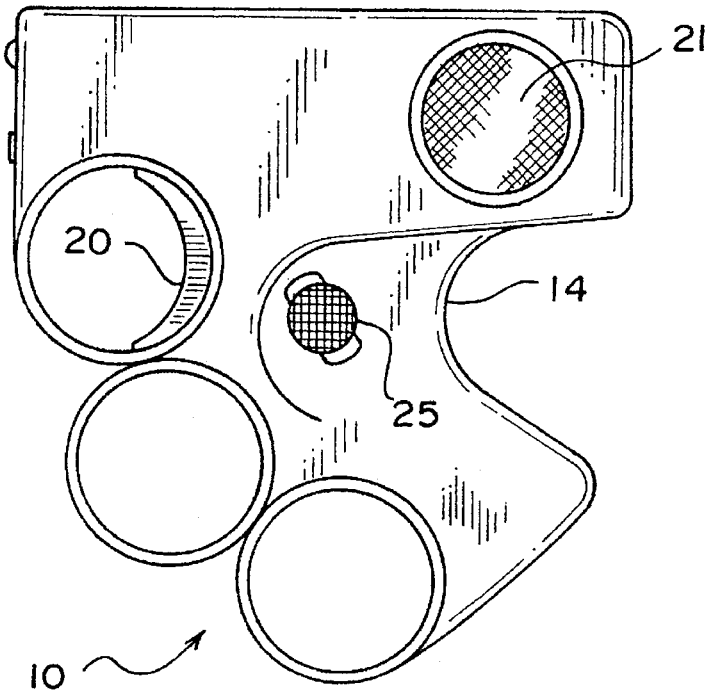
FIG. 3 is a left side view in elevation of the device of FIG. 1, showing the thumb-operated switch for actuating the light.

Referring to the drawings in more detail, a personal security device in accordance with the invention is indicated generally at 10 in FIGS. 1–6. The device comprises a hollow housing 11 having a pistol-like shape, with a handgrip 12 and a barrel 13. The rear of the handgrip is deeply recessed at 14 for receiving the web between the thumb and forefinger of the hand of the user, with the forefinger, middle finger and ring finger adapted to extend through ring-like openings 15, 16 and 17 extending vertically along the front of the handgrip.

A reciprocable trigger actuator 20 is located in the first opening or ring 15 and is operated by squeezing with the forefinger to actuate an audible alarm when the trigger is depressed to a first position, in a manner more fully described hereinafter. The audible alarm includes two speakers 21 and 22 located on opposite sides, respectively, of the device, whereby sound is emitted in multiple directions to maximize the chance of being heard when sounded. Moreover, the placement of speakers on both sides of the device ensures that the alarm will still sound loudly in the event it is dropped and is lying on one side.

Continued depression of the trigger will cause discharge of a noxious chemical, such as mace or pepper oil or the like, through a nozzle 23 located in the front of the device.

A first slide switch 25 is located on the left side of the handgrip (see FIGS. 1 and 3) in a position to underlie the end of the thumb when the device is grasped, and is operatively connected as more fully described hereinafter to selectively energize and de-energize a light 26 located in the front of the device adjacent the nozzle 23. Accordingly, the device may be used as a flashlight simply by operating the switch 25 to turn the light on and off.

A second slide switch 27 is located on the right side of the handgrip (see FIGS. 2 and 6) and is connected with a stop member (described hereinafter) to prevent depression of the trigger beyond an amount that is adequate to actuate the audible alarm. In other words, with the switch in a "safe" position, the trigger cannot be moved a distance necessary to effect discharge of the chemical. In order to prepare the device for use to discharge the chemical, this safety switch is moved into an "armed" or unblocking position so that the trigger can be moved an amount necessary to effect discharge of the chemical.

Figure 4:
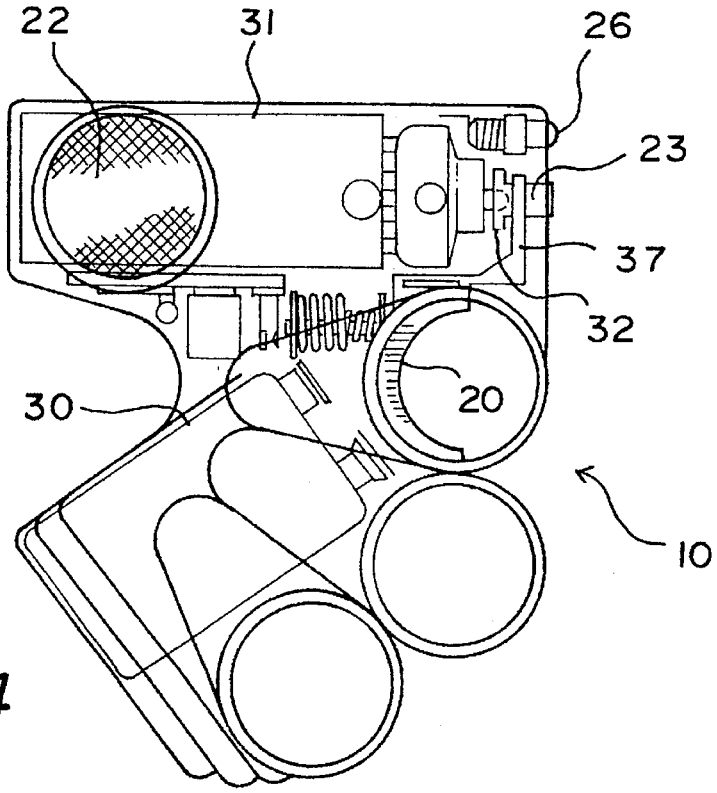
FIG. 4 is a somewhat schematic right side view of the device of FIG. 1, showing the relationship of internal parts of the device.

As seen best in FIG. 4, suitable battery means 30 is stored within the handgrip 12 to provide a power source for the audible alarm and light. The battery may be inserted and removed in a conventional manner through an opening closed by a suitable removable cover (not shown) in the base end of the handgrip.

A container or canister 31 of a suitable noxious chemical is stored within the barrel portion 13, with a discharge valve 32 on the forward end of the canister positioned near the forward end of the barrel and connected with the discharge nozzle 23, whereby depression of the trigger opens the valve and permits discharge of chemical from the canister through the nozzle.

As seen best in FIGS. 4–8, the trigger 20 includes an arcuate portion 33 fitting within the rear of opening 15 for contact with the finger of the user. The arcuate portion is connected with a body 34 having guide ribs 35 and 36 on opposite sides for sliding engagement in mating tracks or channels (not shown) in confronting housing portions. An upstanding, bifurcated yoke 37 on a forward end of the body 34 extends over the front of the discharge valve on the canister so that depression of the trigger moves the yoke rearwardly to open the discharge valve. It should be noted that from its normal, at-rest position, the trigger and yoke must be moved a predetermined amount before the yoke makes contact with the discharge valve to open it. As described immediately below, this is to enable actuation of the audible alarm before the chemical is discharged.

An elongate pin 38 projects rearwardly from the body 34 in a position to engage a movable switch contact 39 that is operatively connected in circuit to energize the audible alarm. The positioning of the pin and switch contact is such that, in one specific embodiment, for example, the switch will be closed and the alarm actuated after approximately one-eighth of an inch of travel of the trigger and pin. In this same embodiment, approximately one-quarter of an inch of travel is required to actuate the discharge valve on the canister of chemical.

A pair of coil springs 40 and 41 are disposed in concentric relationship around the pin 38, and act between a washer 42 engaged against an inside surface of the housing and a washer 43 engaged on the pin, whereby depression of the trigger causes compression of the springs, and release of the trigger enables the springs to return the trigger to its at-rest position. Spring 40 is longer than spring 41 but is considerably weaker, whereby it provides a resilient restoring force to the trigger throughout its range of movement, but offers only slight resistance, i.e., approximately one pound of force in a specific embodiment. Spring 41, on the other hand, is shorter than spring 40 and offers resistance to movement of the trigger only after the trigger has moved through the initial distance described above, and then this spring offers considerably increased resistance, i.e., approximately five pounds in a specific example, before further movement can be achieved to open the discharge valve and effect discharge of the chemical.

Figure 5:
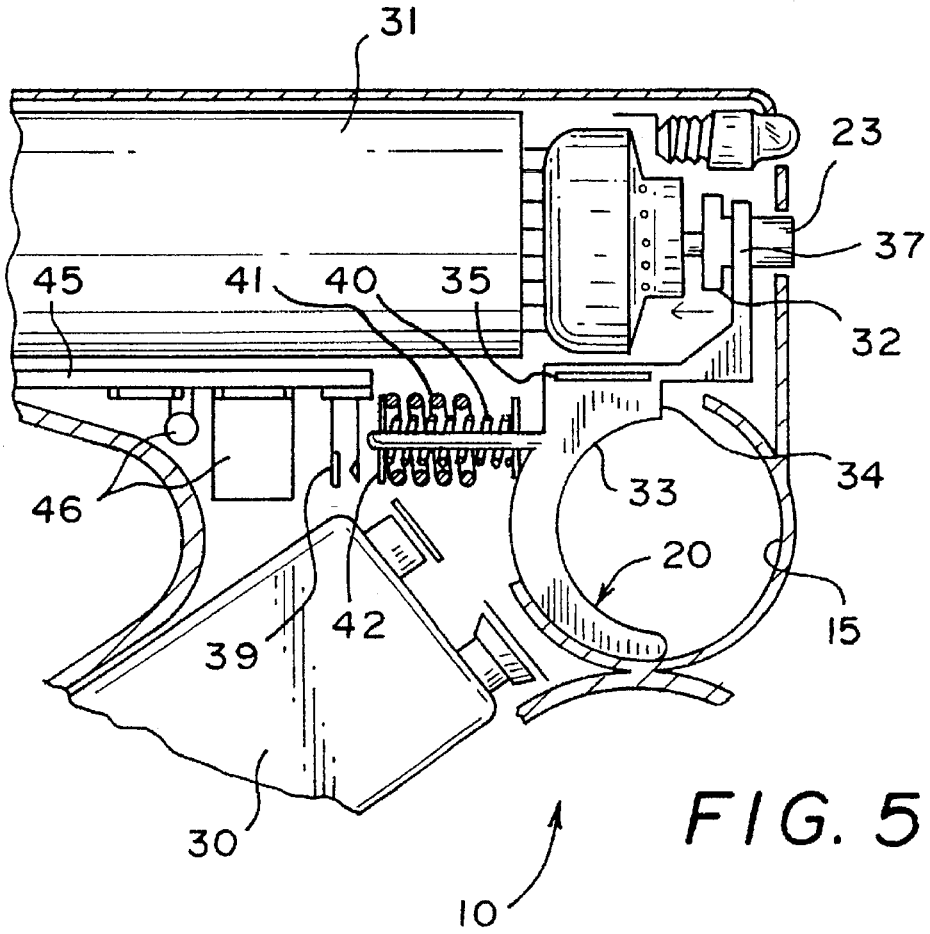
FIG. 5 is an enlarged, fragmentary, cut-away view of a forward portion of the device, showing the relationship of the actuating trigger, audible alarm switch and discharge valve for the chemical.
Figure 6:
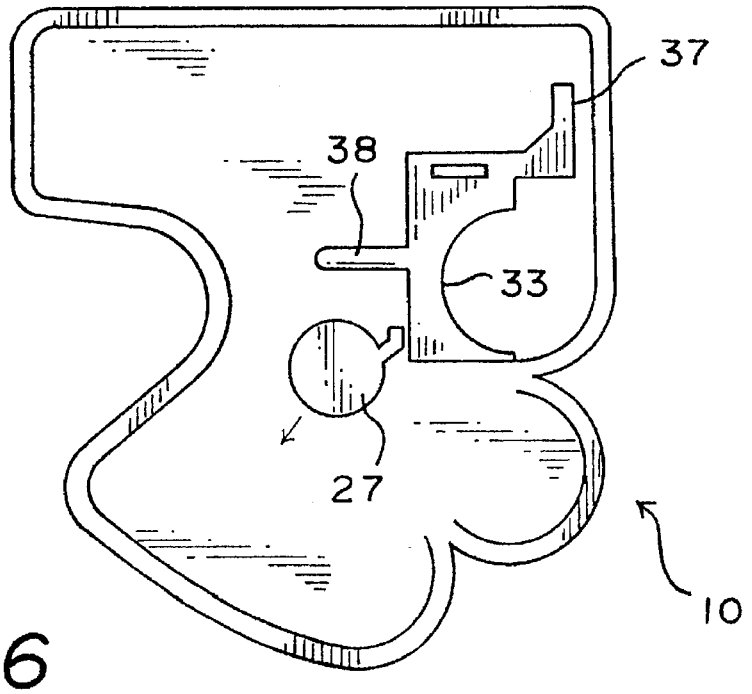
FIG. 6 is a somewhat schematic right side view of the device of FIG. 1, showing the internal operational features of the safety latch.

The circuitry for the electronic components of the invention is carried on a board 45 mounted in the housing near the bottom of the barrel in the space between the canister 31 and the battery 30. As seen in FIGS. 5 and 10, the circuitry includes the contact switch 39 and battery 30, connected through an integrated circuit 46 that includes a timer, which may be of any suitable conventional design, to maintain the alarm circuit energized for a predetermined length of time after it is actuated. For example, the timer could maintain the audible alarm activated for twenty seconds after the trigger is released, so that the alarm will continue to sound even if the device is dropped or knocked out of the user's hand. In one example of the invention, the audible alarm produces a signal of 135 decibels.

In addition, a shock sensor of conventional design is incorporated in the circuit to close the circuit and activate the audible alarm in the event of a sharp blow or jolt imposed on the device. Thus, the audible alarm can be activated even without depressing the trigger, as, for example, if an attacker should strike the hand of the person holding the device, and/or if the device is dropped before the user has a chance to activate the alarm.

In a specific example of the invention, the device is approximately three and one-half inches long by three and one-half inches high, and uses a nine volt battery to power the circuit and alarm. The canister is twenty-two millimeters in diameter and holds approximately one-half ounce of chemical, and delivers or discharges the chemical in one-half second bursts when the discharge valve is operated.

The housing is preferably made of high impact plastic, although any suitable material may be used. The deep recess at the rear of the handgrip provides a support which helps resist dislocation of the device from the hand of the user when it is struck from above, and the rings or openings 15, 16 and 17 along the front of the handgrip not only provide a firmer and more secure grip on the device, but also form a trigger guard to prevent inadvertant depression of the trigger, and assist in quickly orienting and aiming the device through tactile sensation.

Figure 11:
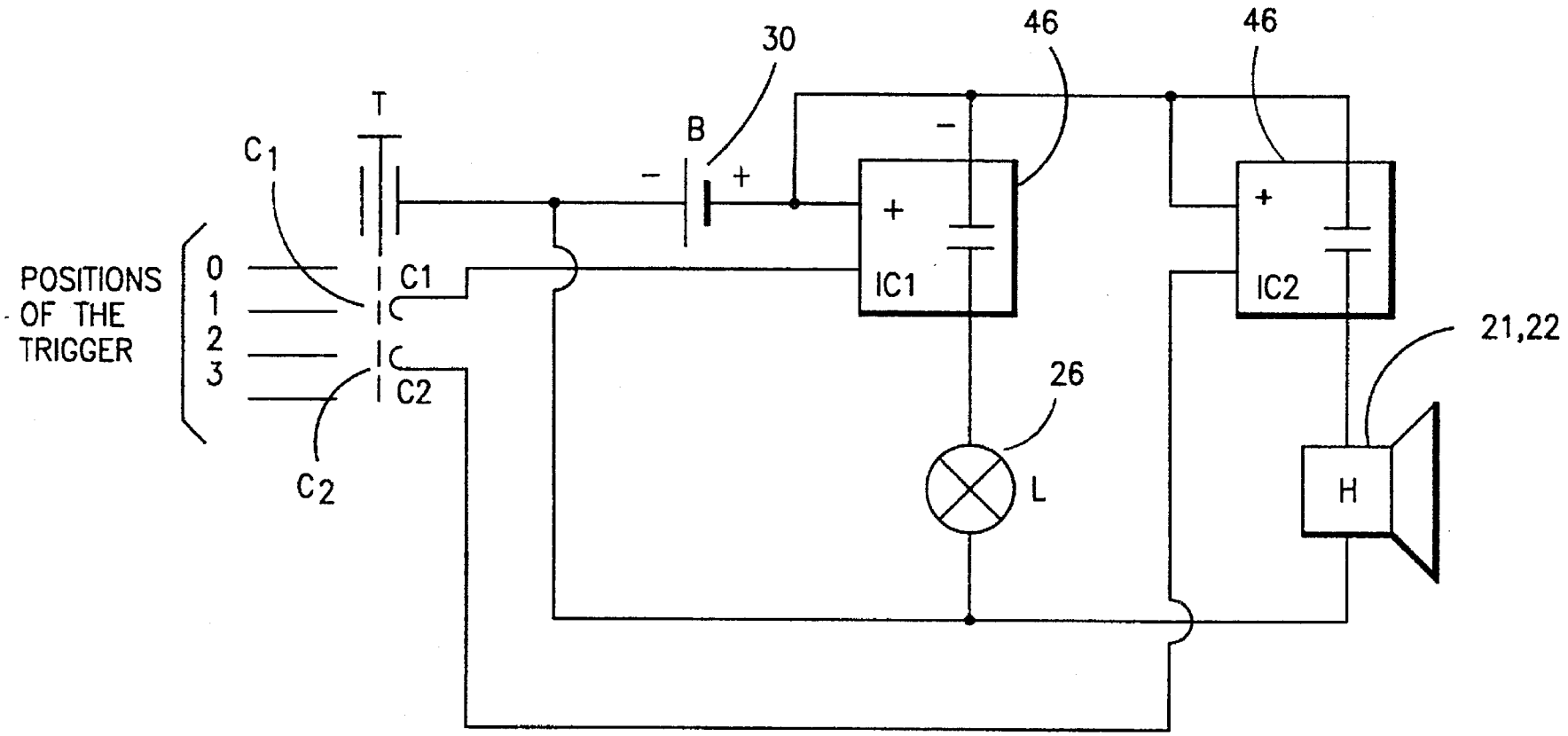
FIG. 11 is a schematic circuit diagram of a second embodiment of the invention, wherein the actuating switches for the light, audible alarm and chemical dispenser are all incorporated into a single unit for staged operation.

A modification of the invention is shown in FIG. 11, wherein the switch for the light is also incorporated into the trigger actuator. Thus, a first contact C1 is provided for actuation upon a first predetermined travel of the trigger to turn on the light, and a second contact C2 is provided for actuation of the audible alarm upon further travel of the trigger actuator. Detents or multiple springs of varying tension (not shown) could be provided to determine the different stages of operation so that the user could easily ascertain when the trigger had traveled the requisite extent to obtain the desired operation. As previously described, complete depression of the trigger would be necessary in order to achieve discharge of the chemical.

Although the invention has been illustrated and described in detail herein, it is to be understood that various changes and modifications may be made therein without departing from the spirit and scope of the invention as defined in the appended claims.

What is claimed is:

1. A portable personal security device, comprising:

a hollow housing of compact size capable of being carried in a pocket or purse, and having a handgrip portion and a barrel portion, said barrel portion having a forward end with a discharge opening therein, and a cavity for receiving a canister of material to be discharged through the opening;

a canister of noxious chemical supported in said cavity, having a discharge valve positioned adjacent said discharge opening, and a discharge nozzle associated with the discharge valve and adapted to open the discharge valve and dispense chemical from the canister and through the opening upon inward movement of the discharge nozzle;

an audible alarm means supported in the housing and having speaker means exposed through the exterior of the housing, said alarm means including switch means for energizing the alarm means; and single movable trigger means supported on the housing and having a first actuator means for operating said switch means to energize the alarm means upon a first predetermined movement of the trigger means, and a second actuator means for moving the discharge nozzle on the canister to discharge said chemical upon a second predetermined movement of the trigger means.

2. A portable personal security device as claimed in claim 1, wherein:

the audible alarm means is connected in a circuit containing a timer means for maintaining the alarm means energized for a predetermined length of time after the trigger means is released.

3. A portable personal security device, comprising:

a hollow housing of compact size capable of being carried in a pocket or purse, and having a configuration similar to that of a pistol, with a handgrip and a barrel;

noxious chemical discharge means connected with a supply of noxious chemical contained in the housing for discharge of the chemical through an opening in a forward part of the barrel;

an audible alarm means carried by the housing for sounding an audible alarm;

light means carried by the housing for emitting light from a forward end of the barrel, whereby the device can be used as a flashlight; and actuator means for selective actuation of the audible alarm means, the noxious chemical discharge means and the light means, said actuator means comprising a single operator for sequentially actuating at least two of said alarm means, light means and chemical discharge means upon predetermined degrees of movement of said operator.

4. A portable personal security device as claimed in claim 3, wherein:

the actuator means includes a common actuator for the noxious chemical discharge means and the audible alarm means, and a separate actuator for the light means.

5. A portable personal security device as claimed in claim 3, wherein:

the actuator means includes a common actuator for the light means, the noxious chemical discharge means and the audible alarm means, said actuator means operative to first energize the light means, next the audible alarm means, and then the noxious chemical discharge means.

* * * * *